US006681023B1

(12) United States Patent
Turnbull et al.

(10) Patent No.: US 6,681,023 B1
(45) Date of Patent: Jan. 20, 2004

(54) RADIAL PICKUP MICROPHONE ENCLOSURE

(75) Inventors: Brian Turnbull, Prince Albert (CA); Dale Zimmerman, Prince Albert (CA)

(73) Assignee: River Forks Research Corp., Saskatchewan (CA)

( * ) Notice: Subject to any disclaimer, the term of this patent is extended or adjusted under 35 U.S.C. 154(b) by 0 days.

(21) Appl. No.: 09/646,079

(22) PCT Filed: Mar. 9, 1999

(86) PCT No.: PCT/CA99/00186

§ 371 (c)(1), (2), (4) Date: Sep. 8, 2000

(87) PCT Pub. No.: WO99/46956

PCT Pub. Date: Sep. 16, 1999

Related U.S. Application Data

(60) Provisional application No. 60/077,366, filed on Mar. 9, 1998.

(51) Int. Cl.[7] ..... H04R 9/08

(52) U.S. Cl. ..... 381/369; 381/338; 381/339

(58) Field of Search ..... 381/369, 170, 381/171, 174, 368, 338, 337, 339, 340, 352, 353, 163, 361

(56) References Cited

U.S. PATENT DOCUMENTS 3,890,474 A * 6/1975 Glickberg ..... 381/369
4,361,736 A 11/1982 Long et al.
4,434,507 A 2/1984 Thomas
4,436,966 A 3/1984 Botros
4,831,656 A 5/1989 Southern et al.
5,650,599 A * 7/1997 Madden et al. ..... 181/218
5,971,096 A * 10/1999 Matsumoto et al. ..... 181/210

FOREIGN PATENT DOCUMENTS

FR 775846 * 1/1935 ..... 381/369

* cited by examiner

*Primary Examiner*—Rexford Barnie
(74) *Attorney, Agent, or Firm*—Sheldon H. Parker

(57) ABSTRACT

A sound pressure waveguide consisting of an input acoustic channel, a compression zone and exit channel with an optional termination baffle. The shape and length of the waveguides are varied to adjust sound pressure gain and to achieve varied sound pickup directivity. The shape and length of the termination baffle, when employed, is also adjustable to achieve varied directivity. The waveguide is shaped from at least two opposing members or sides and at least one sloped member or side. The mounting position of one or more commercially available microphone transducer (s) puts the transducer's diaphragm substantially parallel to the sound path through the waveguide pressure channel. The exit channel is included to let sound pressure pass by the microphone to the pressure channel and through the waveguide to an optional termination baffle, thus preventing significant pressure distortion, sound pressure propagation distortion and undesirable reflections.

10 Claims, 15 Drawing Sheets

FIGURE 1
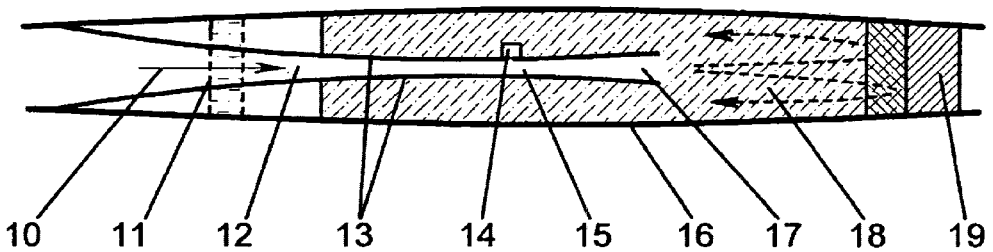
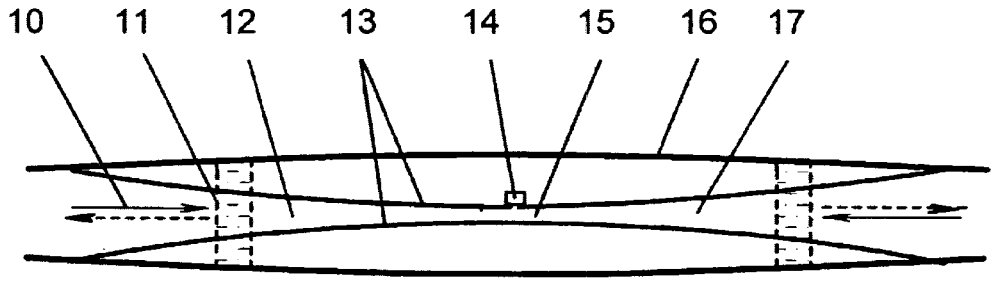
FIGURE 2

FIGURE 7
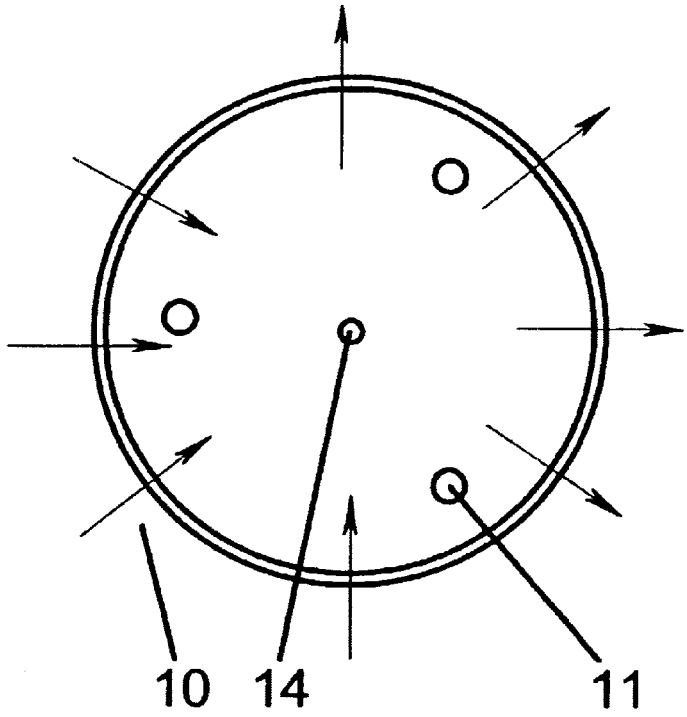
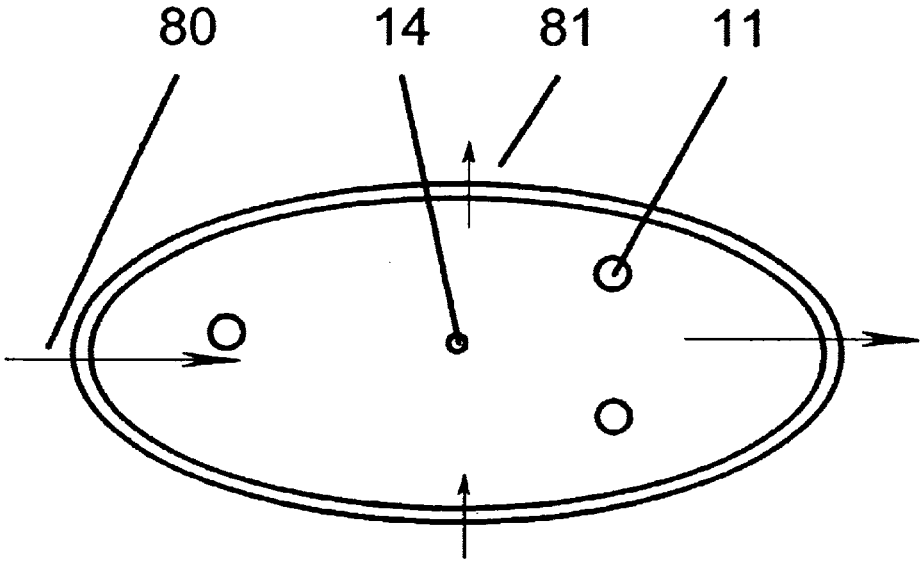
FIGURE 8

FIGURE 9
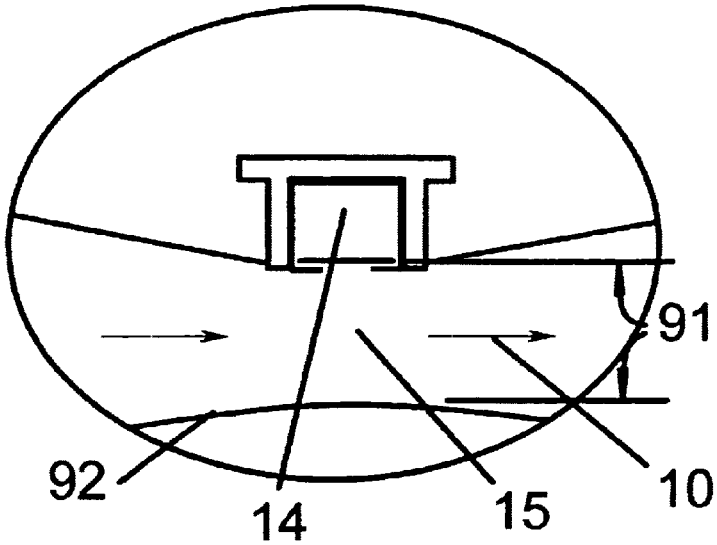
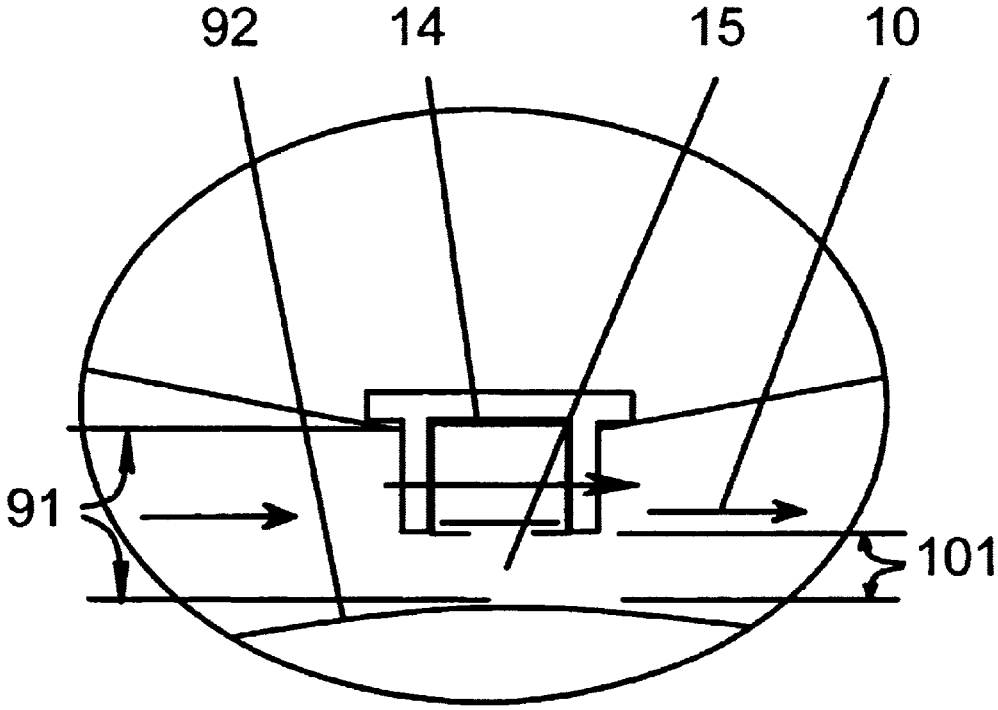
FIGURE 10

FIGURE 11
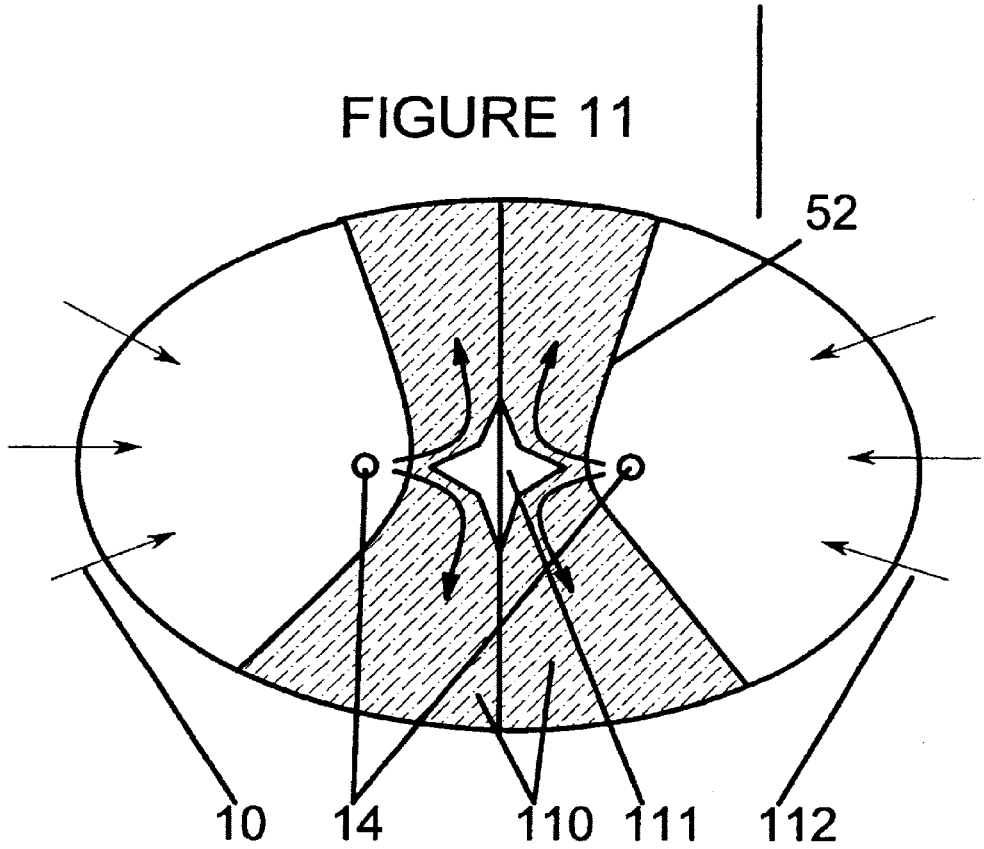
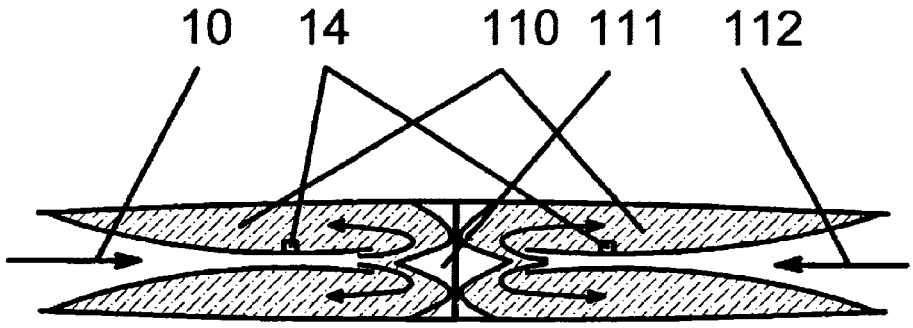
FIGURE 12

FIGURE 13
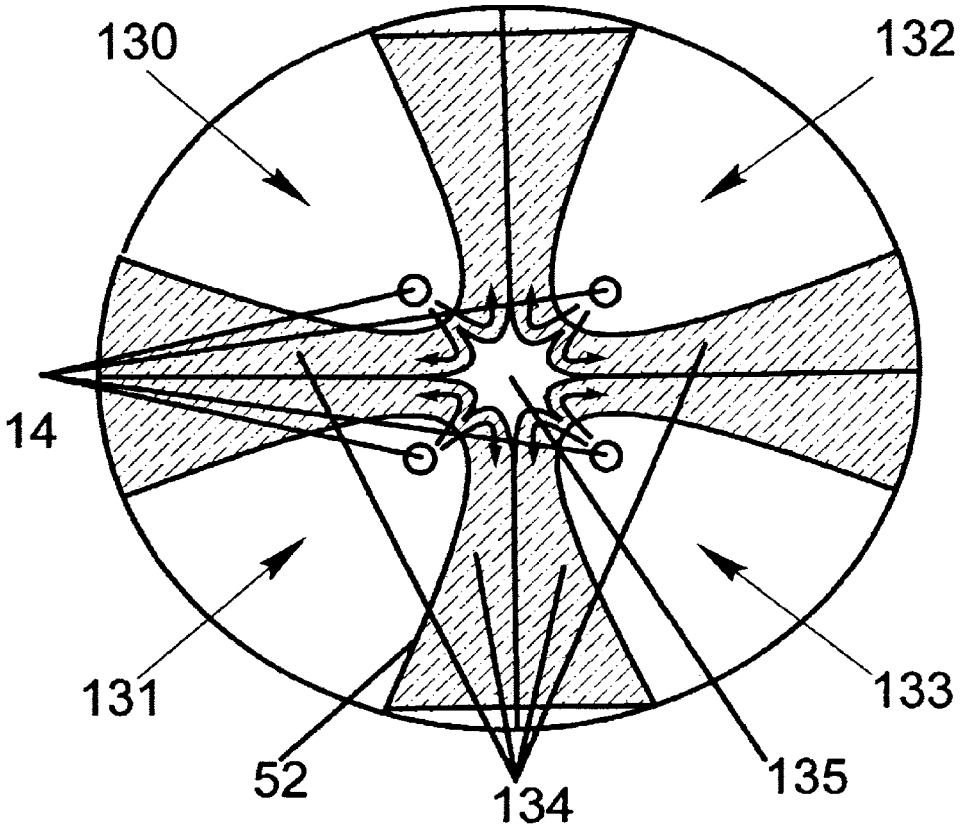
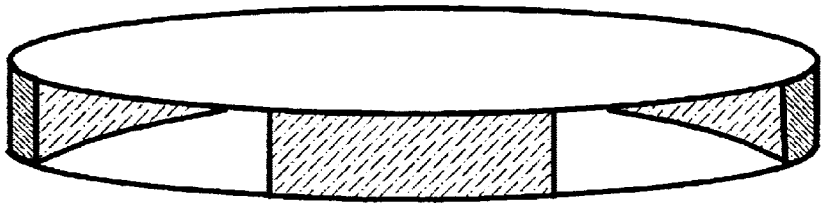
FIGURE 14

FIGURE 15
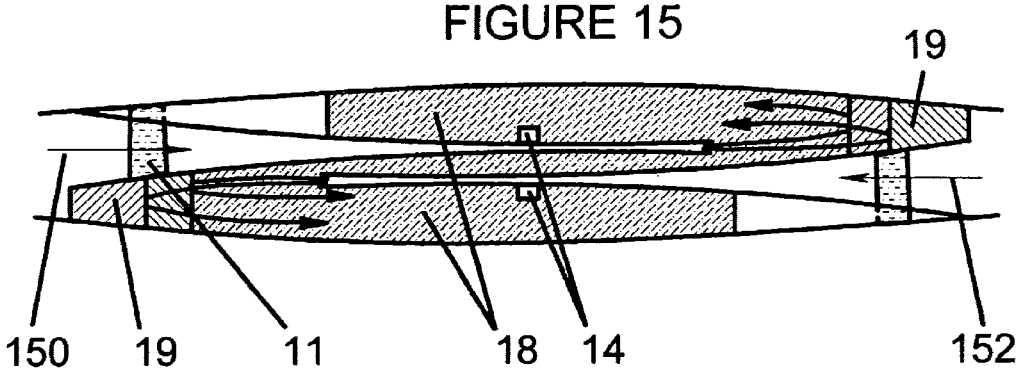
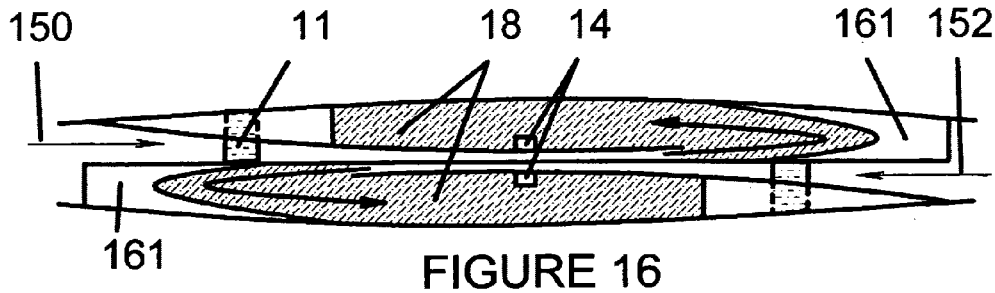
FIGURE 16

FIGURE 17
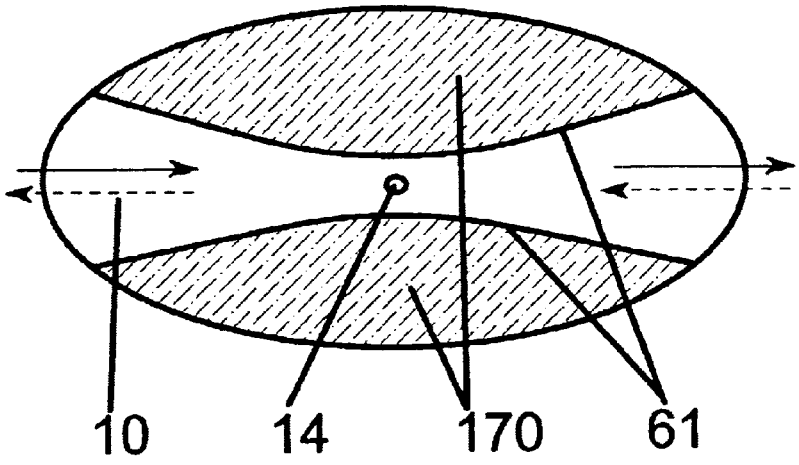
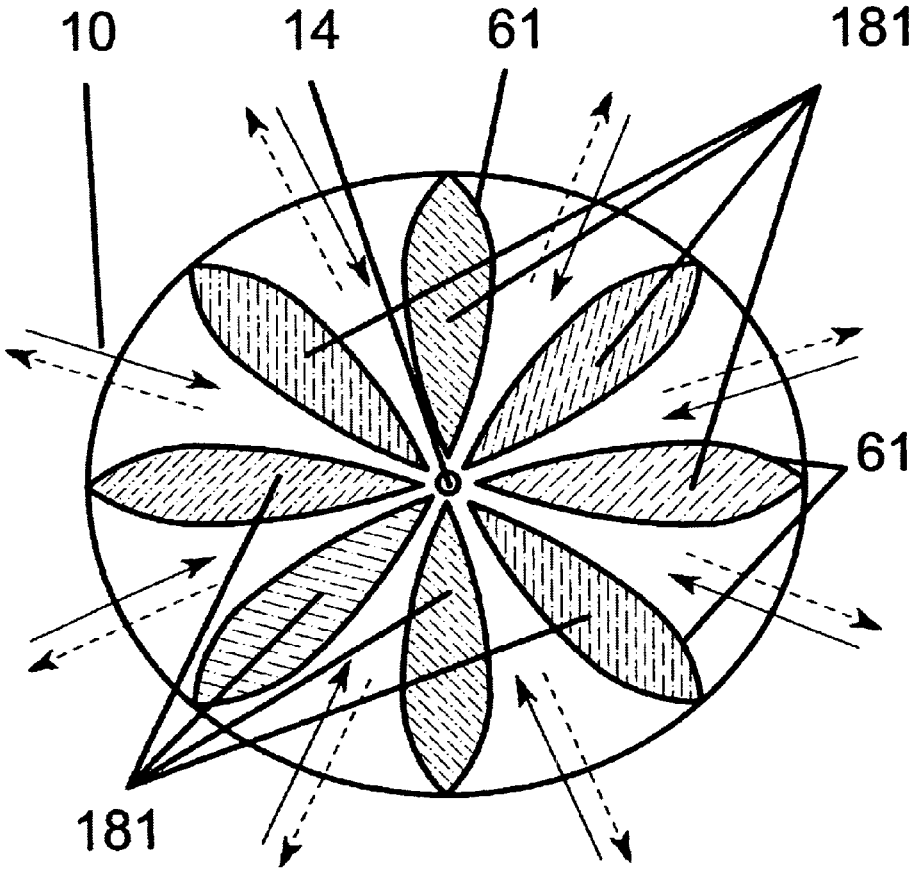
FIGURE 18

RADIAL PICKUP MICROPHONE ENCLOSURE

This application claims the benefit of Provisional application No. 60/077,366 filed Mar. 9, 1998.

BACKGROUND OF THE INVENTION

1. Field of the Invention

The invention relates to a microphone system and more particularly to a microphone system which includes a microphone and a pair of dishes which channel the sound past the microphone.

2. Brief Description of the Prior Art

Various microphones and microphone systems have been developed over the years in an attempt to more accurately capture sound at a distance for both indoor and outdoors applications. Pressure microphones, such as disclosed in U.S. Pat. No. 4,361,736 to Long and Wickersham, dramatically improved the technology, however, problems were still apparent.

U.S. Pat. No. 4,436,966, issued to Botros uses dishes with the sound being received within the concave portion of each of the two dishes to provide bi-directional reception. As the space between the dishes is a null region, the dishes can be in contact with one another without any loss of sound. In the Botros system, the microphone is positioned to respond to the sound coming into the concave portion of each dish, capturing the sound at the apex of the dishes. The Botros dishes can be a portion of a small diameter sphere, or ellipse, with little concern as to depth of the dish. Conversely, in the disclosed microphone enclosure, the angle of the waveguide must be shallow.

U.S. Pat. No. 4,831,656, to Southern et al discloses and claims an angle of about 22 degrees between a flat reflector plate and a cone. According to the '656 patent the predetermined 22 degree angle of the opening between the cone and the reflector plate controls the microphone's environment by deflecting the sound waves produced by conversations into the microphone mounted within the aperture of the cone. As a result of this design, sound waves enter the microphone directly, causing the microphone to produce a significantly higher electrical output in the voice frequency range. The '656 patent further notes that the angle between the cone and reflector plate also produces uniform directional characteristics for the microphone. The 22 degree opening from the sides of the unit is the same at any point in a 360 degree plane creating a horizontal pattern that is uniformly radially directional.

Commercially available PZM microphones from CROWN (Model SOUNDGRABBER U.S. Pat. No. 4,361,736) or RADIO SHACK, and PHONIC EAR (Model AT-560-72-3 U.S. Pat. No. 4,831,656) have been used with unsatisfactory results.

Parabolic microphones have also been used to achieve long range pickup but do so in a very narrow directive pattern. These microphones are also by necessity large. They are impractical then for indoor conference and classroom applications, and outdoors only useful where directivity is desired.

Similarly shotgun microphones are commonly used in long-range pickup situations. They must be used in a large open area to function; they are highly directional, and often too large to be of use in classrooms or conference rooms. As shown in comparisons the instant invention has a much higher acoustic gain than a shotgun microphone.

SUMMARY OF THE INVENTION

The instant invention is capable of matching parabolic range in any pickup pattern variable to 360 degrees in a radial pattern. Additionally the instant invention can match parabolic range in a package less than half the size.

The disclosed invention therefore provides a microphone system having a sensitive, variable radial pickup pattern, which overcomes prior art shortcomings.

The acoustical system of the invention converts sound waves into corresponding signals for use in acoustic data storage and/or driving a speaker. The conversion is only limited by available technology, and is most typically a conversion from sound to electrical signals. The system is equally applicable to a system which could directly convert the sound to laser beams or magnetic fields, or other form which is capable of being recorded in a data storage medium. Magnetic tapes are commonly used for this purpose, but computer type disks can also be used for the storage of data. The form into which the sound is converted, whether it be optical or electrical, or some other form, is not narrowly critical.

The system includes a housing which is formed from a pair of guide members. It is believed that the pair of guide members act as a wave guide, but an understanding of the functioning of the invention is not dependant the exact theory of operation.

A first guide member is positioned proximate a second guide member, and is shaped relative to the second guide member, such that the distance between the first guide member and the second guide member, decreases in the direction of travel of the sound wave, that is, from the outer peripheral edge to inner region. The space between said first guide member peripheral edge and said second guide means peripheral edge forms a sound wave entrance port.

The transducer is positioned proximate the inner region between the two guide members, and is positioned to be responsive to sound waves which travel downstream, from said entrance port, past said transducer. It is essential that the sound waves continue to travel past the transducer, rather than being reflected back in the upstream direction.

That is, the space between the first guide member and the second guide member forms a sound channel, which extends from the sound wave entrance port, at least to a position past the transducer, such that sound waves do not substantially reverse direction and travel toward said sound wave entrance port. Sounds waves enter the system and continue in a directionally unaltered course, until they pass out the opposite end. Preferably, each of said first guide member and said second guide member, is a dish having a convex shape.

In one embodiment, each of the guide members has a peripheral edge which extends 360 degrees, thus producing an acoustical system which is radially directional. In this form, the guide members are convex dishes, and the transducer is position essentially at the center of the dishes.

Where the acoustical system employs a pair of convex dishes, the sound channel is an open, 360 degree channel, in which sound waves enter the sound channel, travel past the transducer and continue to travel in the same direction until they exit the system, thereby forming an radially directional acoustical system.

In another embodiment, a pair of spaced apart side walls extend from, that is, between, the first guide member and second guide member, and from the sound wave entrance port toward said transducer. The first guide member, the second guide member and the pair of side walls, in combination, form the sound channel, and thereby forming a limited direction acoustical system. Looking radially outward, the guide members, are arcuate, that is, in the form of a segment of a pie. Phrased another way, the sound channel, is arcuate, with the directionality of the acoustic system corresponding to the angle of the arc of the sound channel.

In the limited direction acoustical system, a sound absorber is positioned down stream of the transducer to substantially preclude sound waves from reversing direction and traveling past said transducer toward said sound wave entrance port.

The transducer is positioned within said channel, such that said transducer is activated normal to the direction of travel of said sound waves. That is, the transducer is positioned such its active surface, typically a diaphragm, is at a right angle to the direction of travel of the sound waves. The term sound waves, as used herein, is intended to be inclusive of pressure waves, which later term may more accurately define the wave form within the sound channel. Additionally, the sound channel, is understood to operate as a wave guide, but the scope of the invention is not limited to any particular theory of operation. Essentially, the invention is the conversion of sound waves into corresponding signals of another form, as for example, electrical signals. The steps of the invention include guiding sound waves within a channel having a progressively decreasing cross-sectional area, from a channel entrance past a sound wave transducer, and precluding sound waves from re-traveling in the channel, from the transducer toward the channel entrance. This is not intended to mean that the system cannot be an open system in which first sounds waves enter in a first direction and continue until they exit at the opposite end, with other sound waves entering the exit of the first sound wave and exiting at the first sound waves entrance point. A critical point, is that sound waves do not bounce or reflect back, that is, reverse direction, and exit via their own entrance point.

This aspect of the invention can be achieved by limiting sound waves entering the channel, to waves travel from a predetermined area, and absorbing sound waves which have traveled past said sound wave transducer. The sound waves are precluded from re-traveling in said channel, from transducer toward the channel entrance.

BRIEF DESCRIPTION OF DRAWINGS

FIG. 1 is a cross-sectional slice view of the disclosed invention with all components including a termination baffle.

FIG. 2 is a cross-sectional slice view of the disclosed invention in a 360-degree radial pickup. These input-exit channels are bi-directional as indicated by the arrows (10).

FIG. 7 is a top cutaway view of a 360-degree radial pickup microphone.

FIG. 8 is a top cutaway view of a 360-degree radial pickup with a varied circumference.

FIG. 9 shows blowup of the microphone element and the pressure channel (pressure chamber) in a single gap configuration.

FIG. 10 shows blowup of the microphone element and the pressure channel in a dual gap configuration.

FIG. 11 and FIG. 12 shows top cutaway and side cross-sectional views of a stereo multiple waveguide enclosure.

FIG. 13 and FIG. 14 shows top cutaway and side perspective views of a quadraphonic multiple waveguide enclosure.

FIG. 15 shows one version of a stacked multi-waveguide enclosure for a stereo coincident application.

FIG. 16 shows another version of a stacked multi-waveguide enclosure for a stereo coincident application using an inefficient non-symmetrical waveguide.

FIG. 17 is a top cutaway view showing a partition configuration and circumference shape for a bi-directional pickup pattern.

FIG. 18 is a top cutaway view showing a multi-partitioned configuration.

DETAILED DESCRIPTION OF THE INVENTION

Figure 3:
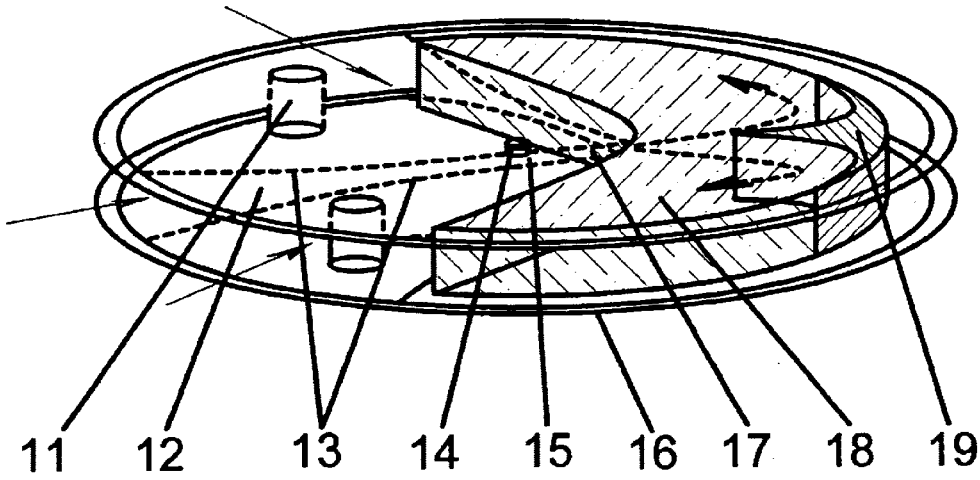
FIG. 3 is a transparent perspective view of a directional embodiment showing the shape and position of one example of a termination baffle insert. Solid arrows indicate sound pressure input, dotted arrows indicate sound pressure exit and diffusion.

A waveguide (acoustic coupling device) with four key components listed below, each variable as later described, is combined to form a microphone enclosure acting as a mechanical acoustic transformer and/or filter.

Input channel consisting of aperture (mouth) and an acoustic coupling channel (12) with 2 or more sides (13) of varied shape and at least one sloped side shaped for efficient pressure transformer function. The input channel connects the aperture (mouth) to the next component, the compression zone.

A compression zone or pressure channel (15), the area where a selected commercially available microphone transducer (14) or several microphone transducers is/are mounted with their diaphragm(s) substantially parallel to an opposing side of and acoustically coupled to the compression zone. This component forms the output of the acoustic transformer, the end of the acoustic coupled input channel and the opening to the next component, the exit channel.

An exit channel (17) consists of an acoustic-coupling channel, beginning with the pressure channel or compression zone and ending in an exit port which can employ an optional termination baffle (18), (19). These four components are combined to form the instant invention.

For the purposes of this patent an acoustic transformer is defined as an acoustic channel which mechanically connects a large area (of any desirable shape) to a small area (pressure channel, compression zone or compression chamber) of a desirable shape. Therefore at least one side of the channel forming this acoustic transformer must have a slope or varied slope in order to decrease the area of the channel progressively from input to output. From this definition it should be clear that the instant invention differentiates from the acoustic channels mentioned here from the acoustic pathways mentioned in U.S. Pat. No. 4,434,507 (Free standing transmitting microphone THOMAS).

The acoustic coupling channels in both the input (acoustic transformer as described above) and exit channels are shaped for the most efficient transfer of acoustic energy into and out of the compression zone, without significant reflections, within the audio spectrum desired for that application. Therefore, depending on the application the expansion (slope) of the waveguide can be linear, exponential or a combination of both. The rate of expansion and angle of the slope whether linear and/or exponential can also change. The length of these channels will also be variable in its pickup pattern by cutting out sections of the substantially parallel dishes and inserting sound absorbing (18) material (see FIG. 3). This material then forms two physical sides but not acoustic channel sides. To clarify, while the sound absorbing material does form a physical side for the waveguide, it cannot contain or reflect sound pressure (only absorb sound pressure) and therefore does not exist as a waveguide channeling side. In FIG. 5, FIG. 6, FIG. 11, FIG. 13 and FIG. 20 a line (52) indicates a waveguide side as described above.

Figure 5:
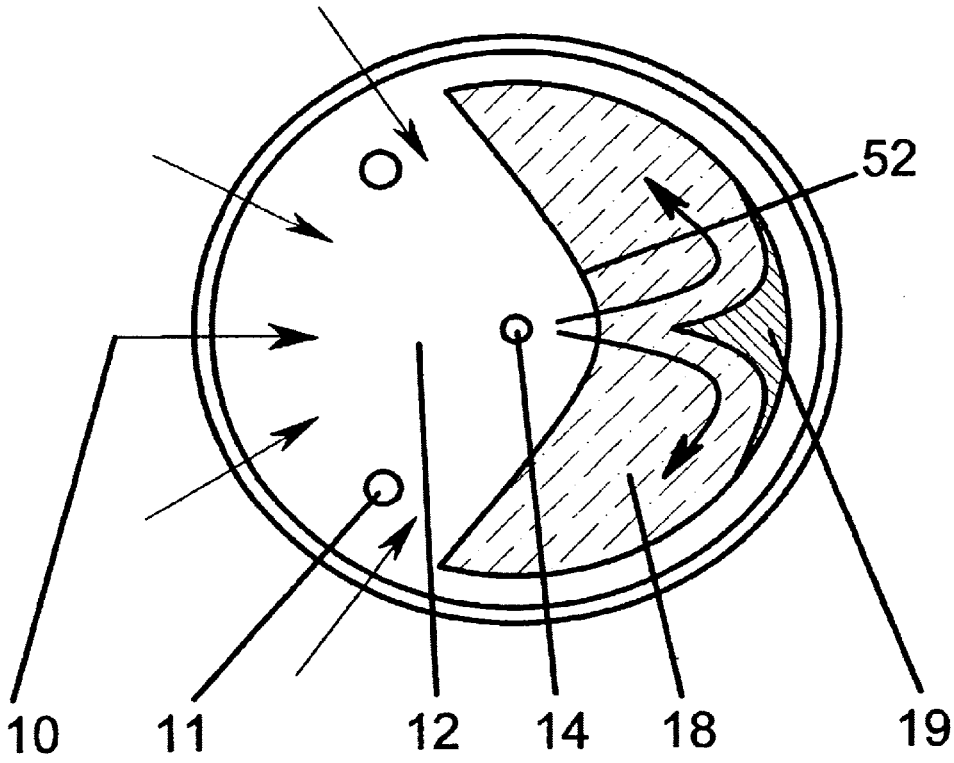
FIG. 5 is a top cutaway view of directional embodiment with termination baffle insert as shown by hatched area.
Figure 6:
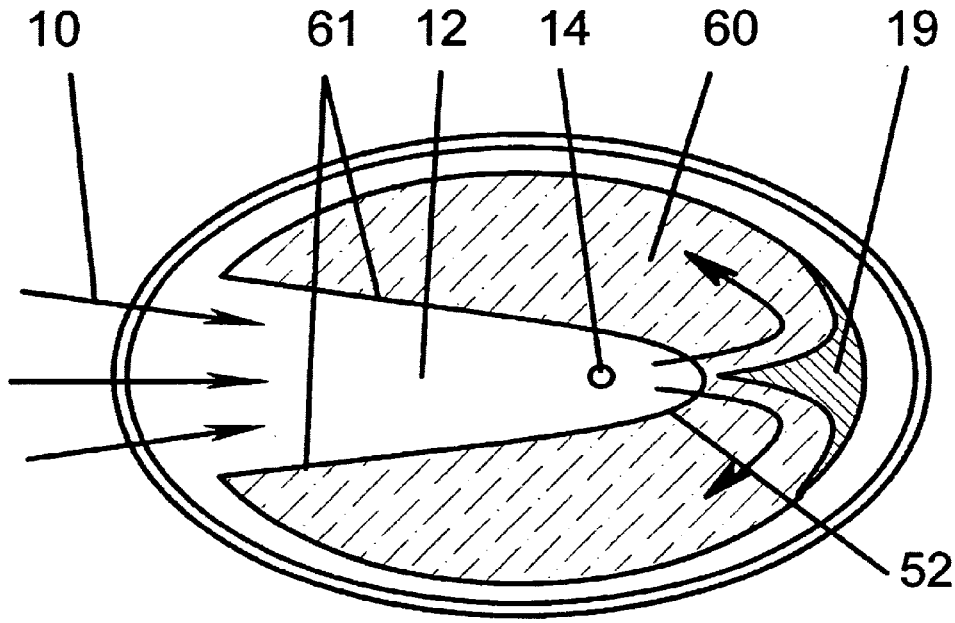
FIG. 6 is a top cutaway view of a very directional embodiment with a termination baffle insert as shown by hatched area. This figure when compared to FIG. 5 shows how pickup pattern can be varied by termination baffle shape and varied circumference of the dishes.

In this preferred embodiment the acoustic absorbing material forms the termination baffle and the pattern of this insert (18) in the enclosure determines the pickup pattern for the enclosure (see FIG. 3, FIG. 5 and FIG. 6).

Through the use of additional partitions and internal separation/termination baffles in combination with sound absorbing inserts as described above, a single enclosure can contain several of the fundamental components (input channels (12), compression zones (15), microphone elements (14), exit channels (17), and termination baffles (18), (19). They can be placed in varied combinations forming a multiplicity of wave-guides in a single enclosure. This is employed in enclosures designed for stereo (FIG. 11 and FIG. 12), bi-directional (FIG. 17), or quadraphonic pickup (FIG. 13 and FIG. 14).

This multi-channel configuration is also useful when employing a combination of waveguide components as a filter allowing for a filter-pressure amplifier combinations in the same enclosure. This allows for useful forms of sound pressure equalization and/or phase cancellation notch filtering at the microphone diaphragm.

Each waveguide within an enclosure can have its own compression zone with its own microphone, its own exit channel and its own optional termination baffle (FIG. 11, FIG. 12, FIG. 13, FIG. 15 and FIG. 16). For some applications several input channels can lead to a single compression zone, with one common microphone (FIG. 17 and FIG. 18). Therefore when referring to an enclosure it is understood that a single enclosure can contain a plurality of waveguides, each with its own unique purpose within the single enclosure.

These variations of shape and structure will then determine frequency response and/or frequency pre-emphasis, frequency rejection and filtering, over all pickup pattern, acoustic transformer matching (for various microphone elements), acoustic gain and overall signal to noise ratio for the combined enclosure, with one or more internal waveguides.

The parameters for the instant invention for the purpose of this patent, allowing for practical variations to address varied applications, are as follows:

Input Channel

An input channel, consists of an input aperture and acoustic coupling channel (12) to termination baffles (18), (19). They can be placed in varied combinations forming a multiplicity of wave-guides in a single enclosure. This is employed in enclosures designed for stereo (FIG. 11 and FIG. 12), bi-directional (FIG. 17), or quadraphonic pickup (FIG. 13 and FIG. 14).

This multi-channel configuration is also useful when employing a combination of waveguide components as a filter allowing for a filter-pressure amplifier combinations in the same enclosure. This allows for useful forms of sound pressure equalization and/or phase cancellation notch filtering at the microphone diaphragm.

Each waveguide within an enclosure can have its own compression zone with its own microphone, its own exit channel and its own optional termination baffle (FIG. 11, FIG. 12, FIG. 13, FIG. 15 and FIG. 16). For some applications several input channels can lead to a single compression zone, with one common microphone (FIG. 17 and FIG. 18). Therefore when referring to an enclosure it is understood that a single enclosure can contain a plurality of waveguides, each with its own unique purpose within the single enclosure.

These variations of shape and structure will then determine frequency response and/or frequency pre-emphasis, frequency rejection and filtering, over all pickup pattern, acoustic transformer matching (for various microphone elements), acoustic gain and overall signal to noise ratio for the combined enclosure, with one or more internal waveguides.

The parameters for the instant invention for the purpose of this patent, allowing for practical variations to address varied applications, are as follows:

Input Channel

Figure 4:
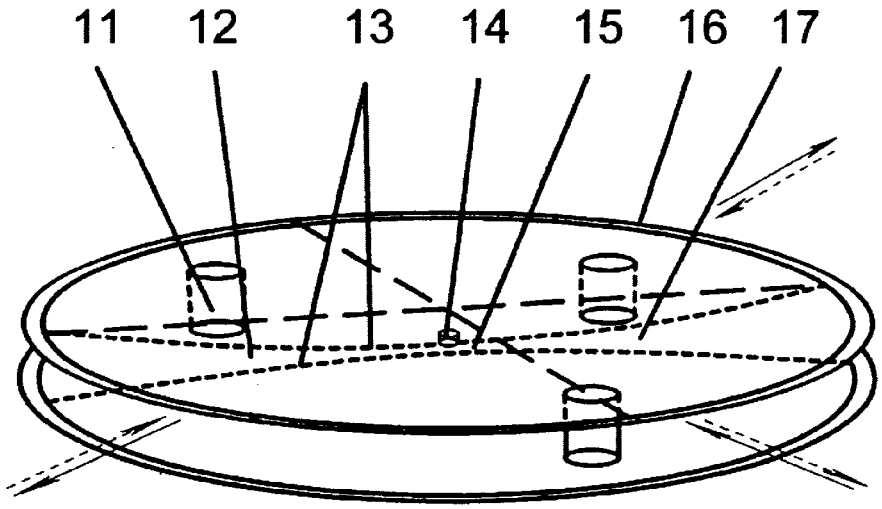
FIG. 4 is a transparent perspective view of a 360-degree radial pickup embodiment. Solid arrows indicate sound pressure input, dotted arrows indicate sound pressure exit.

An input channel, consists of an input aperture and acoustic coupling channel (12) to the compression zone or pressure channel (15). The aperture and channel can be round, elliptical, rectangular, multi-sided (i.e. hexagon), or hemispherical (having a round and a flat side). The aperture and waveguide can have only a top and bottom (13) (2 sides), as in the case of two dishes suspended (by supports 11) back to back and substantially parallel to each other (described in preferred embodiments shown in FIG. 2 side view and FIG. 4 top-view). The length of the input channel preferably is in the range from 0.5 inch to 36 inches. Greater input channel lengths can be used, but are less practical, and are less practical. The channel can vary in shape, in angle of slope and rate of change of angle of slope as it progresses from mouth to compression zone. The channel can be a straight-line shortest distance to the compression zone, or can be bent to follow a path other than the shortest distance for practical considerations (see FIG. 19).

In a uni-directional enclosure configuration virtually any desired narrow to wide-angle sound pickup pattern can be achieved. This can be done by adjusting the size and shape of the input channel aperture (12), acoustic channel sides (top and bottom) (13), and channeling sides (61) and/or termination baffle (18), (60), (110), (134), and (190) and reflectors (19), (111), (135), and (161).

Compression or Pressure Channel

The compression zone is that part of the waveguide forming the connection between the input and exit channels (15). Within the pressure channel a single or several microphone transducers (14) will always be mounted where the pressure gradient of the compression zone will be coupled to the microphone transducer diaphragm(s) (see FIG. 5 for detail in microphone mounting and adjustment). This microphone is mounted in the style of commercially available pressure zone or barrier microphones and will retain all the advantages for this microphone configuration. The barrier microphone (U.S. Pat. No. 4,361,736) requires the diaphragm to be substantially parallel to and in close proximity to a barrier.

The angle of the curvature of the opposing member in the proximity of the substantially parallel diaphragm will always be shallow approximating a flat barrier. The spacing of this diaphragm to opposing (side) member (92) will be a distance of no less than 0.025 (25 thousandths) inches. As illustrated in FIG. 10 the microphone element (14) can be adjusted into the compression chamber (15) but there must be no flat sides perpendicular to the pressure flow shown by the arrows (10) in FIG. 10. To be used this way then the microphone element must be cylindrical with the round side perpendicular to the pressure flow (arrows). The technique of inserting the microphone holder into the compression chamber in an adjustable fashion allows for two gaps. The gap shown (91) can be set for efficient acoustic transformer action and the gap shown as (101) can be set for the optimal pressure zone microphone action. This advantage can be employed as long as the microphone element (FIG. 10—(14) does not restrict or reflect the flow of pressure through the compression chamber to the exit channel and termination baffle (as shown by arrows (10)).

The compression zone will always, in addition to a pressure coupling to a substantially parallel microphone transducer diaphragm(s) just described, have a means for sound to enter and exit, passing through without creating significant pressure reflections or pressure propagation distortion.

The compression zone can be the same dimensions, shape or number of sides as the input and/or exit channels or can be of a different shape and number of sides respectively for the following practical consideration. The shape, volume, gap or gaps to microphone diaphragm, and number of sides of the pressure channel can vary independently as indicated in order to achieve the most efficient acoustic transformer match to a variety of commercially available microphone element(s). These variables provide any waveguide(s) and microphone(s) combination(s) with the desired frequency response, directivity, acoustic transformer pressure gain, efficiency and overall enclosure size for varied applications this microphone enclosure is and will be used for.

Exit Channel (and Optional Termination Baffle)

The exit channel begins at the pressure channel and ends at exit port (17), which can have an optional termination baffle (18) and (19). The purpose of this acoustic coupled channel is to provide a means for sound pressure to exit after passing through the pressure channel (compression zone or chamber). In the cases where a termination baffle is not employed, the exit channel will serve as an input channel for sounds originating from its direction. In this case the input channel will serve as the exit channel. It is this simultaneous vice-versa action as input channel(s) and output channel(s), depending on the direction and amplitude of sound entering the enclosure, that allows this enclosure to act as either a filter, a bi-directional pickup (FIG. 17), or a 360 degree radial pickup device.

The exit channel can employ a termination baffle (18) and (19), consisting of a sound absorbing material or a combination of sound reflective (19) and absorbing material (18). This baffle will terminate the channel by allowing the sound pressure to pass through the exit channel port and be absorbed by or reflected into an absorbing chamber, thus not returning to the pressure channel or compression zone. If a termination baffle is employed the exit channel and port will act as only as an exit since the termination baffle will additionally prevent any sound from entering the exit portion of the waveguide. This creates a uni-directional pickup enclosure or single uni-directional waveguide within an enclosure. This uni-direction pickup pattern can be set, by varying the aperture of the corresponding input channel, to virtually any degree of narrow or wide angle desired (compare top cutaway views FIG. 5 and FIG. 6).

The exit channel and exit port can be round, elliptical, rectangular, multi-sided (i.e. hexagon), hemispherical (having a round and a flat side). The exit channel can have only a top and bottom (2 sides) as in the case of two dishes suspended back to back and parallel. The length of the exit channel is generally equal to or shorter than the input channel. The channel can vary in shape, in angle of slope and rate of change of angle of slope as it progresses from the compression zone to the exit port. The channel can be a straight-line shortest distance from the compression zone to the exit port, or can be bent to follow a path other than the shortest distance for practical considerations.

The waveguides formed from these three (or four with optional termination baffle) components as described above provide useful sound pressure amplification through the acoustic transformer principle, and in some configurations these waveguides have exhibited useful filtering characteristics. These characteristics, in addition to making any selected microphone more sensitive, have been and are useful for pre-emphasis of sound pressure. This sound pressure pre-emphasis on the microphone diaphragm can be used to create a loudness curve at the output of the microphone transducer that complements the high and low frequency roll-off of human hearing of distance sounds, thus providing an additional perceived loudness. Basically speaking it increases the sound pressure, thus providing more microphone signal strength output, in those spectral (bass and treble) regions of low human hearing sensitivity for faint or distant sounds.

This pre-emphasis has also been employed to provide, when combined with an electronic de-emphasis equalization amplifier, noise reduction through a pre-emphasis de-emphasis scheme. Additionally this pre-emphasis, particularly of treble, produces better speech intelligibility for low level voice inflection (sibilance). Vocal sound power and sibilance decrease in spectral areas where this microphone enclosure is able to increase sound pressure. This has enhanced this microphone enclosure's application to conference and classroom listening and recording situations. When designed to maximize treble pre-emphasis the device becomes useful in hearing impaired and security applications.

Having the above advantage this device has been incorporated with a speaker telephone (which it can be integrated into) to form a conferencing telephone. It is also incorporated in intercom systems and internet or network communications. It can be wall or corner mounted. It can be molded into wall panels, intercom panels, computer monitors, and other fixtures for utility in communication applications and to sounds entering from the direction of the smaller arrows designated (81). This allows, by varying the circumference, a microphone enclosure designed to match a particular conference table or room.

Since the mouth of the input channel and the exit port of the exit channels are formed by the same radial 360 degree aperture, the function of input and exit channels depends on this direction of the sound wave. The apex of the two dishes in close proximity, but never in contact, forms the compression or pressure channel (15). This embodiment is useful when long-range pickup is desired in all radial directions at once (a 360-degree panorama). For example it becomes the functional equivalent to many parabolic dishes positioned to pickup in a 360-degree panorama.

The sound pressure filter/amplifier combination in this embodiment also delivers a large amount of spectral pre-emphasis which when combined with the proper microphone element and de-emphasis amplifier provides a means for considerable noise reduction. This pre-emphasis (treble) has also been used to improve speech intelligibility (sibilance) and with its 360-degree long range pickup pattern has outperformed other commercially available microphones for boardroom, classroom and conferencing applications. This configuration is also useful in outdoors 360-degree panoramic ambient sound recordings. When the inherent treble pre-emphasis of this embodiment is employed to the full it is particularly useful for recording birds, bats (ultrasonic) and insects where it is of interest to record all of the above in a given location.

Another preferred embodiment is a typical uni-directional enclosure with a directional pickup pattern custom built for a specific application.

The second embodiment consisting of the same elements as the first embodiment (compare FIG. 1 and FIG. 2) except for the addition of the termination baffle and a sound absorbing insert (18), (19) which makes this unit uni-directional in an application specific pattern. The above can be formed by one piece. Top cutaway views in FIG. 5, FIG. 6, FIG. 11, FIG. 13, and FIG. 20, show variable baffle insert patterns (FIGS. 5–18), (60), (110), (134), (60). The hatched areas represent the sound absorbing insert and termination baffle positions. These examples can use acoustic foam (e.g. SONEX) as a sound absorbing material to form waveguide sides and termination baffles thus having only a top and bottom as shown in FIG. 1. This condition is designated in all figures by lines (52). Input channel can also employ four sides as shown in FIG. 6—(61) to enhance gain and directionality. Solid lines in this view (61) designated hard waveguide sides. Top and bottom are formed as shown as 13, in FIG. 1. As mentioned above lines (52) indicate the portion of a side formed by acoustic degree pickup, will vary in sensitivity around the circumference. As illustrated in FIG. 8 sound entering from the direction of arrows (80) will be amplified more than sounds entering from the direction of the smaller arrows designated (81). This allows, by varying the circumference, a microphone enclosure designed to match a particular conference table or room.

Since the mouth of the input channel and the exit port of the exit channels are formed by the same radial 360 degree aperture, the function of input and exit channels depends on the direction of the sound wave. The apex of the two dishes in close proximity, but never in contact, forms the compression or pressure channel (15). This embodiment is useful when long-range pickup is desired in all radial directions at once (a 360-degree panorama). For example it becomes the functional equivalent to many parabolic dishes positioned to pickup in a 360-degree panorama.

The sound pressure filter/amplifier combination in this embodiment also delivers a large amount of spectral pre-emphasis which when combined with the proper microphone element and de-emphasis amplifier provides a means for considerable noise reduction. This pre-emphasis (treble) has also been used to improve speech intelligibility (sibilance) and with its 360-degree long range pickup pattern has outperformed other commercially available microphones for boardroom, classroom and conferencing applications. This configuration is also useful in outdoors 360-degree panoramic ambient sound recordings. When the inherent treble pre-emphasis of this embodiment is employed to the full it is particularly useful for recording birds, bats (ultrasonic) and insects where it is of interest to record all of the above in a given location.

Another preferred embodiment is a typical uni-directional enclosure with a directional pickup pattern custom built for a specific application.

The second embodiment consisting of the same elements as the first embodiment (compare FIG. 1 and FIG. 2) except for the addition of the termination baffle and a sound absorbing insert (18), (19) which makes this unit uni-directional in an application specific pattern. The above can be formed by one piece. Top cutaway views in FIG. 5, FIG. 6, FIG. 11, FIG. 13, and FIG. 20, show variable baffle insert patterns (FIGS. 5–18), (60), (110), (134), (60). The hatched areas represent the sound absorbing insert and termination baffle positions. These examples can use acoustic foam (e.g. SONEX) as a sound absorbing material to form waveguide sides and termination baffles thus having only a top and bottom as shown in FIG. 1. This condition is designated in all figures by dotted lines (52). Input channel can also employ four sides as shown in FIG. 6—(61) to enhance gain and directionality. Solid lines in this view (61) designated hard waveguide sides. Top and bottom are formed as shown as 13, in FIG. 1. As mentioned above dotted lines (52) indicate the portion of a side formed by acoustic absorbing material.

Figure 19:
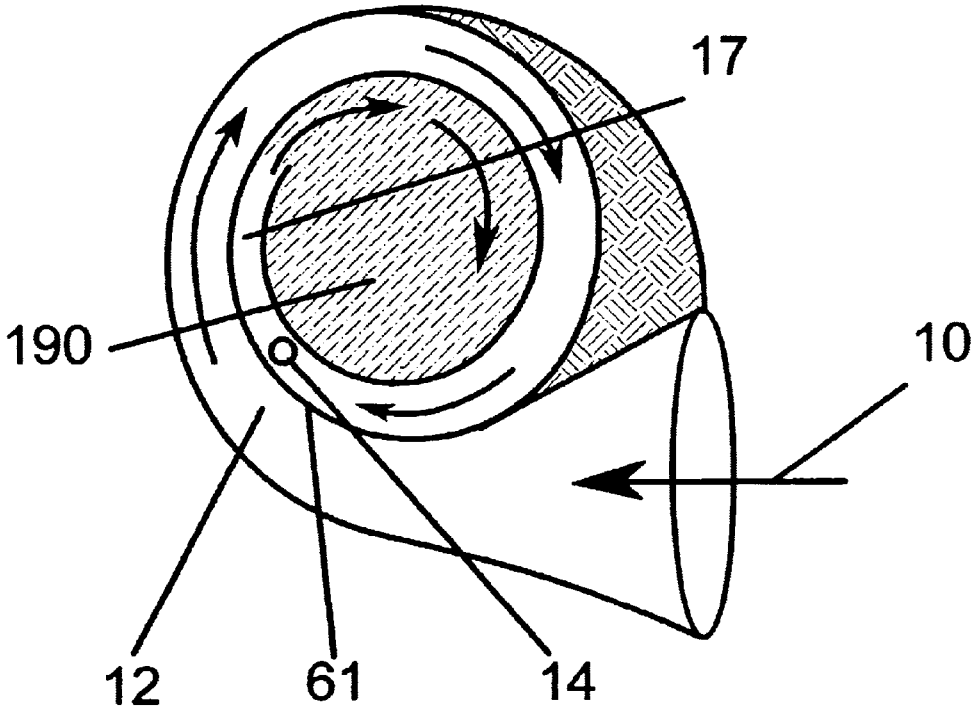
FIG. 19 and FIG. 20 shows two examples of the disclosed invention with extended input channels shaped in conventional horn patterns.
Figure 20:
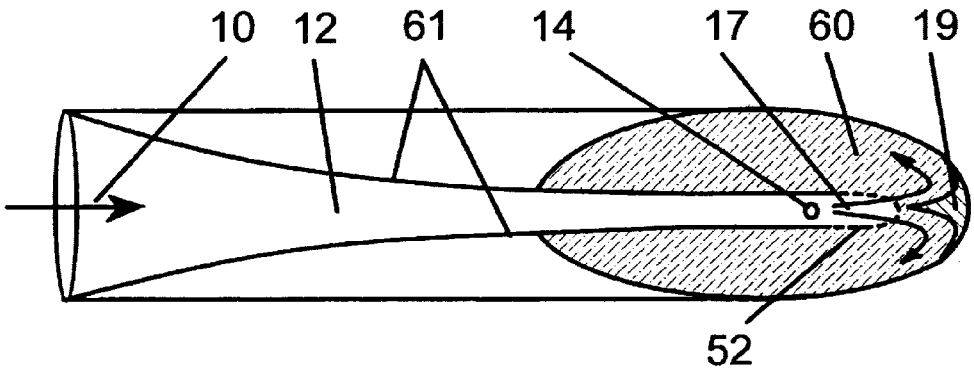

The second embodiment can also use an input channel extended in what appears similar to conventional horn shape (rectangular, circular, elliptical or hemispherical), as shown in FIG. 19 and FIG. 20). The compression channel, exit channel (17) and termination baffle illustrated in these examples remain unique to the instant invention. The "French horn" enclosure of FIG. 19, looks exotic, but is merely a coiled version of FIG. 20, giving a more compact package.

Other preferred embodiments involving multiple waveguides in a single enclosure. The use of multiple waveguides or waveguide components in a single enclosure provides varied and multiple pickup patterns for a single enclosure. Examples are the stereo microphone in FIG. 11 and FIG. 12 and the quadraphonic pickup in FIG. 13 and FIG. 14. In these examples the microphone transducer elements (14) each have their own complete waveguide. The internal baffling, shown as shaded area (110) and (134)) is cut in each case to divide the 360 degree radial pickup into sections (pieces of the pie) of two and four respectively and to provide a common termination baffle (110), (134) and reflector (111), (135) for all sections. In the stereo version sound is picked up for left and right channels in direction of arrows designated (10) and (112). In the quadraphonic version the sound is picked up for each output channel in the directions indicated by arrows (130), (131), (132), (133). Each input section is cut for a desired individual degree of aperture that can optionally be equal for all waveguides in the enclosure. The baffles can also create any number of dead zones. FIG. 12 shows that each waveguide has the same components as the basic directional configuration shown in FIG. 1. FIG. 14 shows a side perspective of the internal baffling in a quad configuration.

FIG. 18 shows a partitioned enclosure with a common microphone (14). This is an example of a multiple-radial pickup pattern. When the acoustic input channel gets long (a very long-range application like security or hunting) but the 360-degree pickup is still required the partitions (181) and sides (61) will improve the efficiency of the input channel acoustic transformer.

Another example of a multi-pattern single microphone configuration is in FIG. 17. This is a bi-directional pickup pattern that differs from stereo in that a single mono output is produced from two opposing directions. This pattern is formed by partitions (170) and sides (61).

FIGS. 15 and 16 show examples of multiple waveguides in a single enclosure in a stacked configuration. This is particularly useful for a stereo coincident application. In a stereo coincident microphone the diaphragms of two microphones (14) are positioned as close as possible while still being isolated from each other and still having exclusive pickup patterns (i.e. right (150) and left channels (152). A varied termination baffle reflector is shown (161). The instant invention as illustrated in FIG. 15 provides this requirement with efficient acoustic transformer coupling.

STATISTICAL COMPARISON TO EXISTING TECHNOLOGIES

Comparisons Test 1

The test measurements were done in an anechoic chamber using a tone sweep. An AUDIO PRESICION TA-1 test set was used to generate the signal, measure and record the results. A YAMAHA MSP5 studio monitor speaker was used to reproduce tone in the chamber.

The microphone tested was embodiment 2, with a 6-inch input channel, a single pressure channel gap of 0.20 of an inch, and a baffled exit channel. The overall diameter of the waveguide including baffle was 12 inches and the input aperture had an area of approximately 5 square inches. The microphone baffling was cut for a 60-degree pickup aperture. The microphone transducer selected was a WM-61B supplied by PANASONIC.

The procedure used was to make and record a tone sweep with the microphone transducer removed from the disclosed enclosure. A second sweep was performed with the same microphone (VM-61B) transducer fastened in the enclosure without changing any equipment settings. The position in the room was maintained as close as possible for each comparison. These out of the enclosure and in the enclosure test comparisons were repeated at various sound pressure levels ranging from 50-db S.P.L. (Sound Pressure Level) to 100-db S.P.L. and for various room orientations. The data from 18 such tests was compiled. For each frequency the "out of the enclosure" measure was subtracted from the "in the enclosure" measured data. These different "in enclosure" and "out of enclosure" versus frequency comparison results (in decibels) for each of the 18 tests where averaged. Then the difference "in/out" of the enclosure versus frequency plot shown as 210 in FIG. 21, was generated. The line (211) is normalized to remove the effects of some room reflections. (Note: the anechoic chamber used was de-rated due to the presence of a grated floor).

Figure 21:
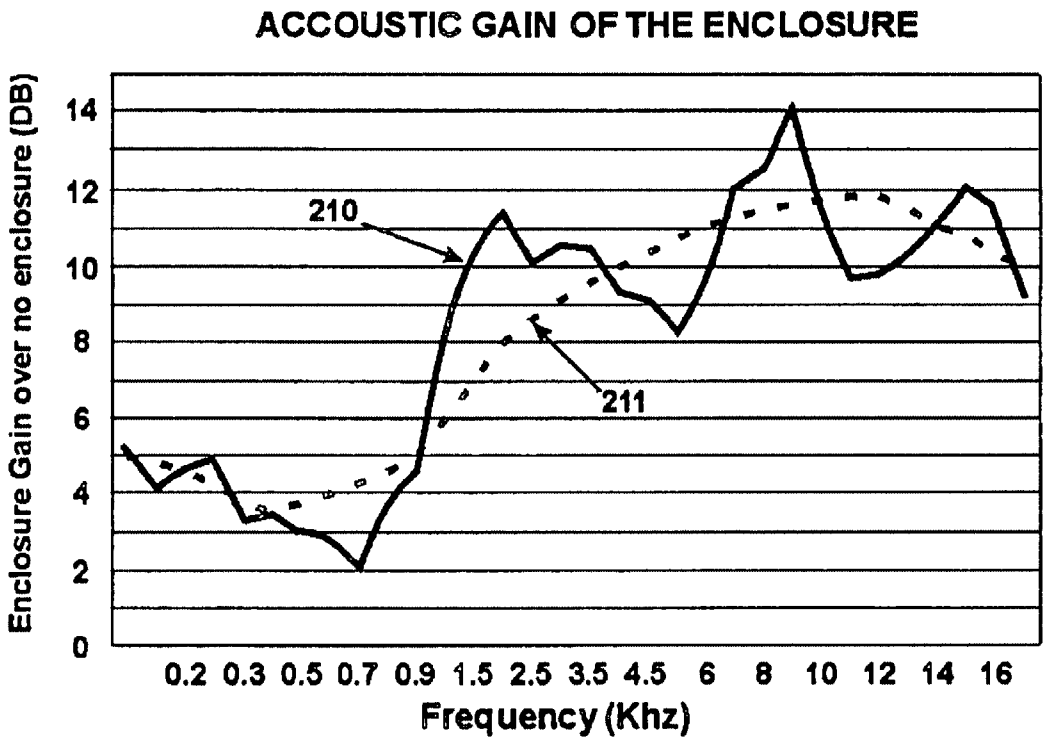
FIG. 21 shows the "in the enclosure" gain over the "out of the enclosure gain" plotted against frequency.

Results:

The resulting plot of FIG. 21, of forward sound pressure gain is comparable to a 24-inch parabolic microphone. Since the disclosed invention is capable of this range with varied pickup patterns up to 360 degrees radially it becomes the functional equivalent of one parabolic in a narrow configuration or at least 6 parabolic microphones in a 360 degree configuration.

The structure of the instant invention, for equal or superior performance, is more compact unit than one 2-foot parabolic and much more compact than six 2-foot parabolic microphones. This makes it an excellent choice for use where parabolic microphones are now used either singly (single disclosed invention with a narrow pickup pattern) or in groups (single disclosed invention with a wide or 360-degree pattern). Its smaller size and long range variable directivity ability will extend its application beyond this existing technology (parabolic microphone). If size is not an issue for an application the instant invention in a directional embodiment can be placed in front of a parabolic dish effectively adding their respective gains to create a hyper-parabolic microphone.

Comparisons Test 2

Direct comparison to a shotgun microphone.

Test was done using an AUDIO CONTROL INDUSTRIAL 3050A R.T.A. as a pink noise source. The R.T.A. also measured the sound source level at 95 db S.P.L. The speaker used (a large TRAYNOR speaker) was positioned 150 yards from both microphones. The signal was recorded in stereo on a PDR 1000 HHB PORTADAT and later analyzed by a software based T.E.F. (Time-Energy-Frequency) analyzer.

The instant invention was configured as a 12 inch diameter single waveguide enclosure with a 6 inch input channel, a 0.2 inch gap in the pressure channel, a 1.5 inch exit channel, and a directional 180 degree termination baffle. The enclosure was equipped with a Panasonic WM61A electret microphone element.

The two microphones, a microphone system of the instant invention as described above, and an eighteen inch barrel SENNHEISER MZW 816 shotgun microphone (without windscreen), were recorded simultaneously at a side by side location on the right and left channels of the DAT. The test was done in open flat grassland in mid-afternoon on a calm, warm (80 degree Fahrenheit), low humidity day. The microphone sensitivities were approximately matched from 500 Hz to 800 Hz.

Figure 22:
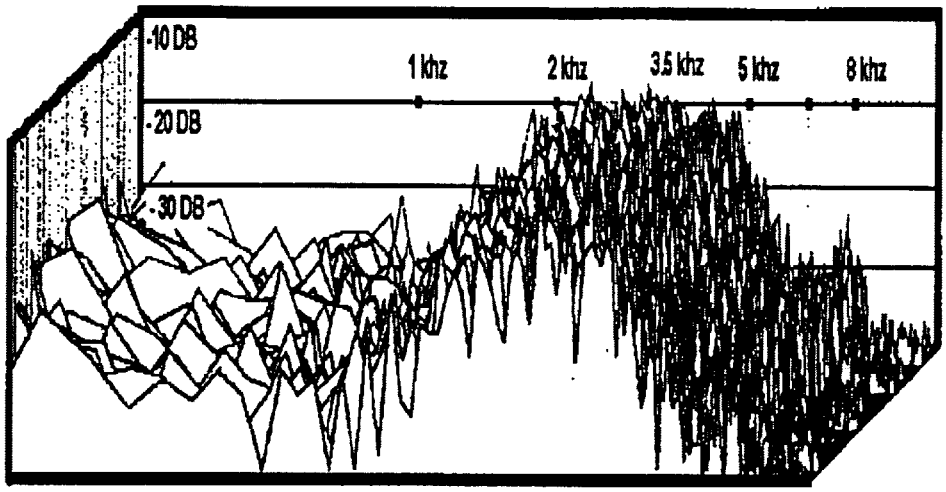
FIG. 22 is a T.E.F. spectral analysis of disclosed invention pickup sensitivity at 150 yards.
Figure 23:
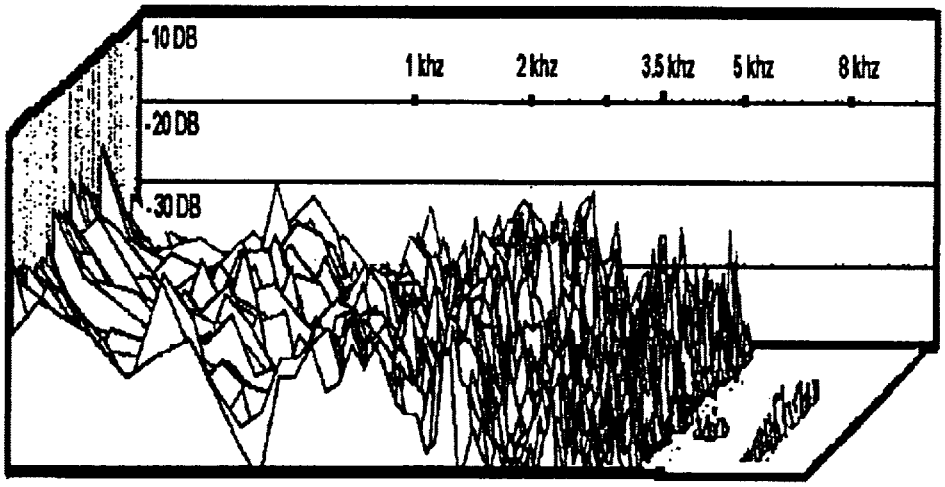
FIG. 23 is a T.E.F. spectral analysis of a shotgun microphone's pickup sensitivity at 150 yards.

Results:

The results shown in FIG. 22 and FIG. 23 indicate that the structure of the present invention provided excellent treble pre-emphasis as described herein. When the invention, as shown in FIG. 23, is compared to the commercially available shotgun microphone in FIG. 22, it is clearly more sensitive in critical treble areas for speech sibilance, outdoor security requirements and outdoor bird and insect analysis. Thus, the system of the present invention has performance superiority over existing technology commonly used for outdoors long-range sound pickup.

Comparison to Prior Art

U.S. Pat. No. 4,831,656, to Southern et al discloses an angle of about 22 degrees between a flat reflector plate and a cone. According to the '656 patent the predetermined 22-degree angle of the opening between the cone and the reflector plate controls the microphone's environment by deflecting the sound waves produced by conversations into the microphone mounted within the aperture of the cone. An acoustic coupled channel is not employed in the '656 patent. Additionally, while the '656 patent does have 2 opposing sides and one sloped side as described in the instant invention, the configuration and linear angle described in the '656 patent deflection cone would be so inefficient as to have no practical value as an acoustic transformer. The only practical use of a flat side with a sloped side for the instant invention is when a second waveguide is incorporated in a vertically stacked multi-waveguide coincident stereo microphone enclosure, as shown in FIG. 16. Here keeping the requirement of keeping microphone diaphragms in close proximity has the tradeoff of some acoustic transformer inefficiency. The angle of the sloped side would, in this stereo microphone, still be much less than 22 degrees. Additionally since the efficiency of the acoustic transformer is already reduced by the non-symmetry of this configuration, a cone would never be employed since this would only add to the inefficiency. This configuration then, first being a stereo microphone (which without baffles '656 cannot be a stereo) and having a shallow curved slope would then be unrelated to the disclosure of the '656 patent.

A pressure microphone, such as disclosed in U.S. Pat. No. 4,361,736 to Long and Wickersham, issued in 1982, the disclosure of which is incorporated herein by reference as though recited in full, is used herein for sound transduction. While the structure of the instant invention bears little physical similarity to the microphone system of the '736 patent, the instant system is understood to be functioning as an enhanced pressure microphone.

While the physical appearance of instant invention in some embodiments described would appear to be related to that of the Botros '966 patent, it has little or no functional similarity. In Botros, the dishes function like a pair of cups or collectors, with the sound being received within each of the two collectors. The space between the dishes is a null region, thereby allowing the dishes to come in contact with one another without any transmission loss. In direct contrast, in the instant invention in its preferred embodiments, the sound received in the two dishes' concave side is not sensed, that is, the concave side corresponds to the null region. The radial 360 degree region between the convex sides of the dishes (forming a 2-sided waveguide—see FIG. 2) is the sound-receiving region, therefore requiring that the dishes be separated. In the instant invention the concave regions of the dishes are insensitive to sound, and to this extent, the disclosed microphone system is not radially directional since the concave sides block sound and are usually covered, shown as 16 of FIG. 2. Conversely, in the Botros system, the microphone is positioned to respond to the sound coming into the cup, or concave region, of each dish. In the instant invention, the microphone element is directed to the space between the convex sides of the dishes. Thus null zones and active zones in Botros and in the instant invention are reversed, and although the physical structure of the instant invention bears an esthetic resemblance to that of Botros '966, the two are operationally and technically unrelated.

Another critical difference between the Botros patent and instant microphone system is that in Botros the dishes can be a portion of a small diameter sphere, or ellipse, whereas in the instant invention the angle of the dished surface of the waveguide must be shallow. Botros' '966 patent is not the only patent to either teach away from, or be unconcerned with the depth of the dish (angle of curvature of the waveguide). For example, U.S. Pat. No. 4,831,656, discloses and claims an angle of about 22 degrees between a flat reflector plate and a cone. According to the '656 patent the predetermined 22 degree angle of the opening between the cone and the reflector plate controls the microphone's environment by deflecting the sound waves produced by conversations into the microphone mounted within the aperture of the cone. As a result of this design, these sound waves enter the microphone directly or are deflected to it by the cone causing the microphone to produce a significantly higher electrical output in the voice frequency range. There again is no disclosure of an acoustic coupling channel or an acoustic transformer action.

By way of critical contrast, the instant invention requires a very shallow angle at the apex or pressure channel proximate to the microphone, which can progressively open to a wide angle to maintain efficient acoustic coupling. The initial region and the adjacent regions require an angle substantially below 22 degrees. The instant system, like the '656 system, and unlike '966, is responsive to sound between the two opposing members, rather than responding to sound entering one or both of such members. Unlike the '656 device the members the instant invention form a waveguide with a preferred curved surface with a progressively increasing angle between the two members. The angle between the two members at the pressure channel, proximate the microphone, must be shallow, and very substantially under the required angle of about 22 degrees of the '656 patent.

As previously described the principle behind the instant invention is acoustic coupling U.S. Pat. No. 4,831,656 describes the cone as "a vertical boundary which deflects the sound waves into the opening of the microphone". The disclosed invention uses the principle of acoustic coupling where a large area is coupled to a small area through a waveguide or acoustic transformer. In the prior art the deflection of sound will, as described, reflect high frequency signals to the mouth of the microphone element but will not enhance mid and low frequency sounds. Through use of a waveguide and acoustic coupling the disclosed system obtains transfer of sound energy for a greater portion of the spectrum, with higher acoustic gains possible by simply deflecting the sound to a specific area. A properly designed acoustic transformer can transfer up to five octaves of sound energy. In addition to the above the disclosed design principle also provides the novel ability to shape the spectral response and acoustic gain of the microphone enclosure by varying the shape of the waveguide(s). The '656 and the '736 patents do not disclosure a comparable system.

This shaping of the spectral response can be illustrated by the comparison of a skilled musician who may be able to play a recognizable tune on a funnel but can only reproduce the full spectral beauty of the music by use of a trumpet, French horn, saxophone or clarinet. These musical instruments vary in the shape and length of their "waveguides" (all share the principle of acoustic coupling) but require very application specific waveguide shaping to produce the range of sounds they do.

Additionally the use of internal baffles and a termination baffle are at no time mentioned in any patents referenced. This baffling is key to the novelty given the instant invention's use of this baffling to shape uni-directional pickup patterns tailored to specific applications and to control sound pressure propagation distortion.

Also, since the angle of the opening proximate to the microphone element in the disclosed waveguide is, by necessity, much less than the 22 degrees taught in the '656 patent, the instant invention has better vertical axis rejection giving it a more defined and controllable pickup pattern. Additionally due to the lower angle the disclosed radial horn waveguide can be extended to 38 inches or more, giving exceptional acoustic gain. Such an extension for the '656 patent would create, at an extended angle of 22 degrees, a device too large to be practical for use as described by patent '656 and in this extended form patent '656 would obtain very little addition acoustic gain. Finally the published operating instructions for commercially available microphones which incorporate the features of U.S. Pat. No. 4,831,656 suggest a requirement to place the microphone on a table top or flat surface. The disclosed microphone enclosure does not have this requirement and is equally useful outdoors and in varied recording environments as it is specifically useful in conference rooms or classrooms. Thus by combining a variable acoustic transformer "horn in reverse" with a pressure zone microphone (mounted in a compression chamber), an exit port and pickup pattern shaping internal baffling a unique product is produced.

What is claimed is:

1. An acoustical system for converting sound waves into corresponding signals for use in acoustic data storage and/or driving a speaker, said system comprising:

a housing, said housing comprising a first guide member and a second guide member, said first guide member having a peripheral edge and an inner region, and said second guide member having a peripheral edge and an inner region, said first guide member being positioned proximate said second guide member, and being shaped relative to said second guide member such that the distance between said first guide member inner region, and said second guide member inner region is substantially less than 22 degrees and the distance between said first guide member inner region and said second guide member inner region and the space between said first guide member peripheral edge and said second guide member peripheral edge forms a sound channel having a sound wave entrance port, a sound transducer for converting sound waves into electrical signals, and said transducer being positioned substantially flush with the surface of said first guide member inner region, and positioned to be responsive to sound waves which travel downstream, from said entrance port, wherein said sound channel extends from said sound wave entrance port, past said transducer, such that sound waves do not substantially reverse direction and travel toward said sound wave entrance port.

2. The acoustical system of claim 1, wherein each of said first guide member and said second guide member has a convex shape.

3. The acoustical system of claim 2, wherein each of said first guide member and said second guide member peripheral edge extends 360 degrees and said acoustical system is radially directional.

4. The acoustical system of claim 2, further comprising a pair of spaced apart side walls extending from said first guide member to said second guide member, and from said sound wave entrance port toward said transducer, said first guide member, said second guide member and said pair of side walls, in combination, forming said sound channel, thereby forming a limited direction acoustical system.

5. The acoustical system of claim 4, further comprising sound absorber, said sound absorber being positioned down stream of said transducer or substantially preclude sound waves from reversing direction and traveling past said transducer toward said sound wave entrance port.

6. The acoustical system of claim 1, wherein said transducer is positioned within said channel, such that said transducer is activated normal to the direction of travel of said sound waves.

7. The method of converting sound waves into corresponding signals of another form, comprising the steps of:

creating a sound channel by spacing two convex guide members to form a progressively decreasing cross section from a periphery of said convex guide members to an apex of said two convex guide members, positioning a sound wave transducer within of said two convex guide members at said apex of said two convex guide members, guiding sound waves through having said progressively decreasing cross-section to said sound wave transducer, guiding said sound waves past said sound wave transducer periphery through a said sound channel whose cross-section area of said sound channel increases from said to said periphery.

8. An acoustical system for converting sound waves into a form which can be recorded in an acoustical data storage media, comprising:

a pair of curved guide members, said pair of curved guide members being positioned relative to each other to form a sound channel having a progressively decreasing distance between said pair of curved guide members from the periphery to a center point of said pair of curved guide members, forming an upstream channel from said periphery to said center point and to a downstream end channel from said center point to said periphery, a sound wave transducer, said sound wave transducer being positioned substantially flush with the surface of a first of said curved guide members proximate said center point of said sound channel, such that sound waves travel past said sound wave transducer, and are precluded from return travel toward said upstream end of said channel.

9. The acoustical system of claim 8, wherein said pair of curved guide members are convex dishes, and said sound channel is an open, 360 degree channel, whereby sound waves enter said sound channel, travel past said transducer and continue to travel in the same direction until said sound wave exit said system, thereby forming an radially directional acoustical system.

10. An acoustical system for converting sound waves into a form which can be recorded in an acoustical data storage media, comprising:

a pair of curved guide members, said pair of curved guide members being positioned relative to each other to form a sound channel having a progressively decreasing distance between said pair of curved guide members from the periphery to a center point of said pair of curved guide members, a sound wave transducer, said sound wave transducer being positioned substantially flush with the surface of a first of said curved guide members proximate said center point of said sound channel, a pair of spaced apart side walls extending along a portion of said periphery between said first curved guide member and said second curved guide member to form a sound wave entrance port, a sound chamber within said sound channel, said sound chamber being formed by said pair of spaced apart side walls, said sound chamber extending from said sound wave entrance port past said transducer, said sound waves being precluded from return travel toward said sound wave entrance port by said side walls, thereby defining a limited direction acoustical system.

* * * * *